United States Patent [19]

Murphy et al.

[11] 4,428,698

[45] Jan. 31, 1984

[54] GEOTEXTILE FOR PAVEMENT OVERLAYS

[76] Inventors: Jerry C. Murphy, Rte. 8, Pinedell, Monroe, N.C. 28110; Ronald E. Sanders, P.O. Box 3624, Rock Hill, S.C. 29730; Warren S. Harmon, 6610 Ironkettle Rd., Matthews, N.C. 28105

[21] Appl. No.: 179,578

[22] Filed: Aug. 21, 1980

[51] Int. Cl.[3] ..... E01C 11/18

[52] U.S. Cl. ..... 404/17; 404/70; 404/75; 428/220; 428/229; 428/257; 428/258; 428/259

[58] Field of Search ..... 57/207, 208, 260; 428/257, 258, 259, 220, 229, 371, 373; 139/383 R, 420 R, 422; 404/17, 70, 75

[56] References Cited

U.S. PATENT DOCUMENTS

| | | | |
|---|---|---|---|
| 2,854,352 | 9/1958 | Gronemeyer | 428/229 |
| 3,200,576 | 8/1965 | Maerov et al. | 139/426 R |
| 3,317,366 | 5/1967 | Dionne | 139/420 R |
| 3,400,004 | 9/1968 | Corry | 139/422 |
| 3,443,541 | 5/1969 | Chopra | 428/97 |
| 3,496,714 | 2/1970 | Schroeder | 57/207 |

*Primary Examiner*—James J. Bell

[57] ABSTRACT

There is disclosed an improved woven geotextile for use immediately under a pavement overlay. It comprises a high bulk entangled yarn interwoven with tape. It has a shrinkage force of less than 100 gm/inch at 300° F. at constant length in both warp and weft directions, most preferably less than 5 gm/inch.

12 Claims, No Drawings

GEOTEXTILE FOR PAVEMENT OVERLAYS

BACKGROUND OF THE INVENTION (i) Field of the Invention

This invention relates generally to improved geotextiles for building longer lasting roads. More particularly, it relates to a novel type of fabric in which high bulk yarn is interwoven with tape; its use in building roads; and the improved road thereby obtained.

(ii) Description of the Prior Art

The term "geotextile" is of very recent origin. It is typically used to describe a fabric designed for use in or on the ground in civil engineering and construction applications to promote durability. In general, such durability is obtained by the geotextile functioning as (i) reinforcement and load distributor; and/or (ii) a permeable membrane that permits passage of liquids; and/or (iii) a confiner that prevents erosion or a separator that prevents intermingling of different granular masses on each side of the fabric.

Numerous different geotextiles have been used in repairing a cracked load bearing surface, such as a road pavement by steps including: (a) filling the cracks with bituminous or elastomeric material; (b) applying an asphalt tack coat to the filled surface; (c) laying a geotextile on top of the tack coat; and (d) applying and compacting hot asphalt concrete on top of the geotextile.

Procedures for bonding the fabric are well known in the art. For example, see "PM-13 Mirafi® 140 Fabric for Longer Lasting Pavement Overlay" by Celanese Fibers Marketing Company, 1978.

A detailed description of the prior art relating to geotextiles, particularly woven fabrics, for building longer lasting roads is found at the beginning of U.S. patent application Ser. No. 160,264 ("Geotextile for Pavement Overlay", W. S. Harmon, filed June 17, 1980), now abandoned. Such description is hereby incorporated by reference. Also, at least part of the invention disclosed in the forementioned application was reduced to practice before the conception of the present invention.

The forementioned application claims various embodiments of an improved woven geotextile suitable for use immediately under a pavement overlay. Broadly, that improved geotextile comprises a porous cap coated woven tape fabric having a shrinkage force of less than 30 gm/inch at 300° F. at constant length in both warp and weft directions. The product permits reduction of both "reflective cracking" and "thermal construction cracking" in repaired roads.

U.S. Pat. No. 3,443,541 (Chopra) discloses tape interwoven with a bulky yarn for use as a carpet backing.

Also, U.S. Pat. No. 3,400,004 (Corry) discloses stretchable bulky yarns interwoven with unbulked yarns as a precursor for coated fabrics, particularly in the upholstery field.

None of the known prior art discloses any geotextile comprising a woven bulked yarn.

SUMMARY OF THE INVENTION

In contrast to the forementioned prior art, there has now been discovered an improved woven geotextile for use immediately under a pavement overlay, which comprises a bulky entangled yarn interwoven with tape.

Use of the invention permits elimination of the cap coating process described in the forementioned application, and its attendant problems. At the same time, the desired geotextile properties such as increased surface friction, permeability and bulk are readily obtained. Use of the invention eliminates fabric strength and elongation loss caused by needling woven tapes. It also eliminates fabric variability problems associated with lack of uniformity of a precursor staple web.

DESCRIPTION OF PREFERRED EMBODIMENTS

The preferred embodiments of the invention are illustrated by the Example described below, and by the claims. The invention is, of course, not limited to the Example.

EXAMPLE 1

A core-bulked yarn was prepared in the manner given below.

A "core-bulked yarn" is defined as a bulky or textured yarn composed of two sets of filaments, one of which is straight to give dimensional stability and forms a core around and through which the other set is entangled in coils or loops. This is one of several types of entangled yarns. Normally entangled yarns are prepared by the air-jet texturing method.

The "air-jet texturing" method is defined as a method of texturing by which yarn is fed through the turbulent region of an air jet at a rate faster than it is drawn off on the far side of the jet. In the jet, the yarn structure is opened, loops are formed, and the structure is closed again. Some loops are locked inside and others are locked on the surface of the yarn.

A 2400 denier core-bulked yarn was prepared using conventional air-jet texturing method. The core component was a 500 denier polyethylene terephthalate continuous filament yarn into which a 1000 denier polyethylene terephthalate continuous filament yarn was entangled to form the core-bulked yarn. The resulting core-/effect yarn had a tenacity of 1.3 g/d as measured by ASTM-D-885-78; a rupture elongation of 23.9% as measured by ASTM-D-885-78; and a dry heat shrinkage at 300° F. of 3.4% as measured by ASTM-D-2259-77. The core yarn had a tenacity of 7.5 g/d; elongation of 24.0%; dry heat shrinkage of 4.0% at 350° F. and contained filaments of 5.2 dpf. The untextured effect yarn had a tenacity of 8.2 g/d; elongation of 10.0%; dry heat shrinkage of 11.0% at 350° F. and contained filaments of 2.1 dpf.

Also, polypropylene tapes were made using conventional equipment for extruding a molten film; stretching the extruded film; and slitting the stretched film into tapes. The stretching operation involved the use of a lower draw ratio than is customary for non-pavement overlay applications. The low draw ratio resulted in the tapes having a dry heat shrinkage of 300° F. of 3.3% as measured by ASTM-D-2259-77; a tenacity of about 3.6 g/d as measured by ASTM-D-885-78; and a rupture elongation of 60% as measured by ASTM-D-885-78. The tapes were about 0.109 inches wide, 0.0016 inches thick, and had a denier of about 1050.

These tapes were woven into the warp and the core-bulked yarn into the weft on a conventional loom using a plain weave construction to form a 5.4 oz/yd$^2$ fabric comprised of 10 ends/inch of warp tapes and 12 picks/inch of weft core-bulked yarns. No heat stabilization of the woven fabric using "tentering" or other heat relaxing process was involved. The resulting woven geotextile fabric had a rupture elongation of 49×39% and a grab strength of 89×96 lbs as measured by ASTM-D-1682-64.

When tested for properties related to performance in asphalt overlay pavement systems, the woven geotextile was found to have a shrinkage force at 300° F. of 12.3×42.5 gm/in of fabric. The asphalt retention of the fabric was 10.6 oz/ft$^2$ with an initial asphalt pentration of 1.2% and a final asphalt penetration of 54.4% as measured by the tests defined below.

The "fabric shrinkage force test" was performed in the following manner. A one inch wide fabric sample was clamped securely between pneumatic jaws in a heated chamber of a conventional stress-strain testing machine. The gage length between jaws was maintained at 3 inches. Jaws, tape specimen, and the environment around the specimen are maintained at 300° F.±1° F. during testing. The testing machine measures and records the thermal shrinkage force exerted by the fabric on the jaws as a function of time at a constant gage length by conventional load cells. Testing begins when the fabric is secured between the preheated jaws in the 300° F. chamber. Shrinkage force is continuously measured until a "steady state" condition is reached in which the shrinkage force no longer increases or decreases with time. That steady state value in gm/in of fabric is recorded as the test result for that specimen. Results are given as the average of five test specimens for the warp direction and five for the weft direction for the fabric.

The "initial asphalt penetration test " was used to determine the amount of tack coat that permeates through the fabric before the asphalt overlay is applied. The initial asphalt penetration test was performed in the following manner. Hot asphalt tack coat at 275° F. was applied to a smooth surface maintained at 100° F. The tack coat amount was 0.10 gal/yd$^2$. After the applied tack coat temperature reached 100° F. a 4 inch diameter sample of fabric was laid into the tack coat and covered with a prewash 4.5 inch diameter filter paper followed by a glass plate and an 8 lb weight at ambient conditions. After 45 minutes the experimental setup was disassembled and the filter paper weighed to determine the amount of tack coat that penetrated through the fabric into the filter paper. The initial asphalt penetration was determined as the ratio of the weight of tack coat absorbed by the filter paper to the original weight of tack coat under the fabric expressed as a percent. Results are recorded as the average of six specimens per fabric sample.

The "final asphalt penetration test" was used to determine the amount of tack coat that permeates through the fabric and into the asphalt overlay after the asphalt overlay is applied. The final asphalt penetration test was performed in a similar manner to the initial asphalt penetration test except the glass and weight are preheated to 300° F. before they are placed on the fabric and filter paper. After placing the weight the whole assembly is placed in a hot air oven for 3 minutes at 300° F.±4° F. The assembly is then removed and allowed to cool to ambient temperature. The final asphalt penetration is then determined and calculated in the same manner as for initial penetration.

The foregoing fabric is found to be eminently suitable as a geotextile for preventing both reflective cracking and thermal construction cracking in resurfaced roads.

What we claim is:

1. An improved resurfaced road comprising (a) a crack-filled old pavement; (b) an asphalt concrete layer above said old pavement; (c) a geotextile between said old pavement and said asphalt layer, for preventing reflective cracking wherein the improvement comprises:

said geotextile comprises a core-bulked yarn interwoven with tape fabric firmly embedded between and contacting said old pavement and said asphalt concrete layer, wherein said core-bulked yarn comprises two sets of filaments, said first set being straight to give dimensional stability and forms a core around and through which said second set of filaments is entangled in coils or loops.

2. The road of claim 1 wherein said geotextile has a shrinkage force of less than 100 gm/inch at constant length in both warp and weft directions.

3. The geotextile of claim 1, wherein said core-bulked yarn has a first-set/second-set weight ratio in the range of from 5/95 to 60/40.

4. The geotextile of claim 1, wherein said first and second sets are continuous filament yarns.

5. The road of claim 1 wherein said geotextile has a melting point greater than 250° F. and is selected from the group consisting of polyolefins, polyesters, polyamides, and polyvinylidene-chlorides.

6. The road of claim 1, wherein said tapes have width within the range of 0.030 to 0.150 inches; thickness within the range of 0.0005 to 0.0100 inches; denier within the range of 250 to 3000; free shrinkage at 300° F. within the range of 0.0 to 10 percent by ASTM D-2259-77; and elongation at break of more than 35 percent by ASTM D-1682, Grab Strength method.

7. The road of claim 6, wherein said tapes' elongation is more than 50 percent.

8. The road of claim 7, wherein said tapes' elongation is more than 60 percent.

9. The road of claim 1 wherein said geotextile has a retention ability of 0.05 to 15.0 oz/sq. ft. by the Texas Asphalt Retention Text D.O.T. Special specification Item 3099, Fabric Underseal.

10. The road of claim 1, wherein said core-bulked yarn has tenacity in the range of from 0.5 to 15 gpd; elongation in the range from 10 to 400 percent; filament deniers in the range from 2 to 10 d.p.f.; and yarn denier in the range from 250 to 5,000.

11. The road of claim 1, wherein said core-bulked yarn is a filling yarn.

12. The road of claim 11, wherein said filling yarn is predominantly located on one side of said geotextile.

* * * * *